US005282294A

United States Patent [19]

Spaller, Jr. et al.

[11] Patent Number: 5,282,294

[45] Date of Patent: Feb. 1, 1994

[54] APPARATUS FOR PRODUCING LAYERED MATERIAL

[75] Inventors: Albert E. Spaller, Jr., Johnson City; Whitney B. Carter; Fred W. Horne, both of Kingsport; Richard W. Nutter, Sr., Blountville; David W. Thompson, Kingsport, all of Tenn.

[73] Assignee: Eastman Kodak Company, Rochester, N.Y.

[21] Appl. No.: 923,210

[22] Filed: Jul. 31, 1992

[51] Int. Cl.[5] ..... B65H 39/00

[52] U.S. Cl. ..... 19/65 T; 28/263; 226/21

[58] Field of Search ..... 19/295, 302, 0.46, 0.48, 19/0.51, 0.56, 65 T; 28/263, 268, 221; 156/324; 226/18, 21, 22, 23; 270/52

[56] References Cited

U.S. PATENT DOCUMENTS

| | | | |
|---|---|---|---|
| 2,346,258 | 4/1944 | Hooper | 28/263 X |
| 3,277,537 | 10/1966 | Roeder et al. | 19/0.48 |
| 3,452,410 | 7/1969 | Dixon et al. | 28/221 X |
| 3,526,350 | 9/1970 | Tradewell et al. | 226/18 |
| 3,763,520 | 10/1973 | Izawa et al. | 28/263 X |
| 4,556,208 | 12/1985 | Campbell | 226/21 X |
| 5,018,267 | 5/1991 | Schoen | 156/324 X |
| 5,146,651 | 9/1992 | Duffey et al. | 19/65 T |

*Primary Examiner*—Andrew M. Falik
*Assistant Examiner*—John J. Calvert
*Attorney, Agent, or Firm*—John F. Stevens; William P. Heath, Jr.

[57] ABSTRACT

An apparatus is disclosed for producing a band of rectangular cross section having at least two layers of material. The apparatus includes means for advancing a first band along a predetermined linear path and means for guiding a second band into layered alignment with the first band. The apparatus further includes a roll around which the second band is partially wrapped prior to contacting the first band, the second band having an initial tangential contact position with the roll along a line on the surface thereof extending generally axially with respect to the roll. The roll is tiltable in a plane defined by the axis thereof and the initial tangential contact position of the second band, whereby the lateral take-off position of the second band may be controlled by tilting the roll so as to guide it into aligned juxtaposition with the first band to form a layered, substantially rectangular tow band.

2 Claims, 3 Drawing Sheets

APPARATUS FOR PRODUCING LAYERED MATERIAL

TECHNICAL FIELD

This invention relates to apparatus for producing continuous lengths of layered material. The apparatus is capable of controlling the lateral position of the individual layers so they can be brought into predetermined lateral position with respect to other layers. The invention is particularly useful in the production of tows of filamentary material wherein individual bands of tow (sometimes called "ends") are to be layered in alignment with each other to produce a tow band which is rectangular in cross section.

BACKGROUND OF THE INVENTION

Although the apparatus according to this invention has broader applications with respect to aligning layers of continuously advancing material to form a layered assembly, it is especially useful in the production of filamentary tow for making articles such as cigarette filters. Accordingly, the invention will be described herein in that context.

In the normal process for the production of cellulose acetate cigarette filters, as described for example in British Patent 909,940, cellulose acetate is spun through a spinnerette having, for example, 100–200 orifices. The bundles of filaments or "ends" from each of a number of spinnerettes and their associated "spinning cabinets" are assembled to form a tow. This tow is normally composed of filaments of about 1.5 to about 10 denier and the denier of the tow is from about 25,000 to about 100,000. The tow is then sent to a crimping device in the form of a flat band of, for example, 4 to 10 filament-diameters thickness. The width of the tow or band may vary considerably, depending on the number of ends combined.

A typical crimper comprises a pair of nip rollers by which the tow is forced into a stuffing box against back pressure. This causes the tow to crimp.

It is, of course, highly desirable that the tow inserted in the stuffer box be of uniform cross-section. Tow which is not uniform in cross-section results in nonuniform density within the crimping chamber (stuffer box) which causes nonuniform crimp, undesirable wear on the crimper rolls and parts and can produce edge defects in the tow band.

The present invention provides apparatus for arranging the ends in an orderly or regular fashion, i.e., of rectangular cross section to overcome the difficulties of the prior art.

DESCRIPTION OF THE INVENTION

Figure 1:
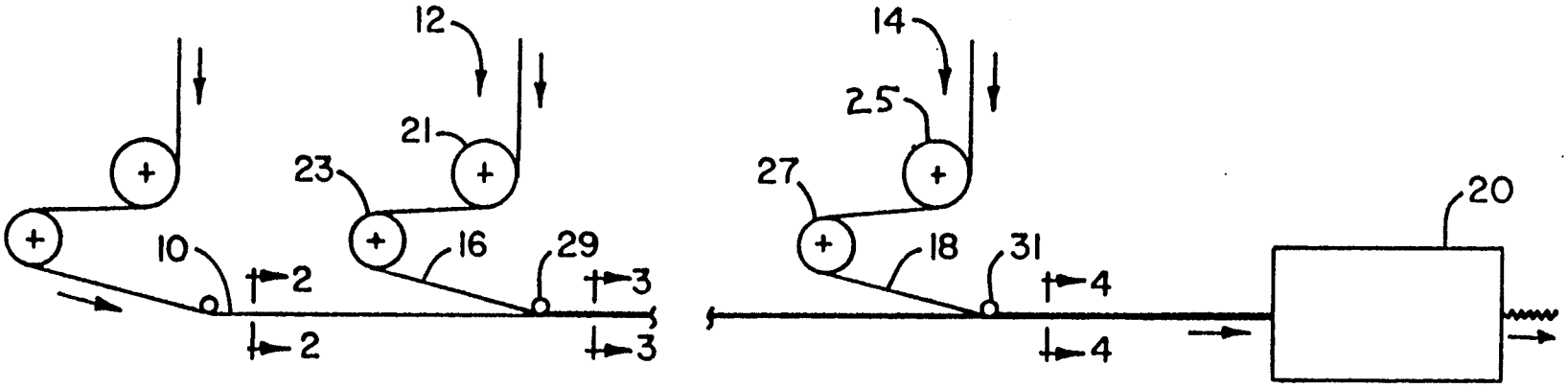
FIG. 1 is a schematic elevation view of apparatus for forming a layered assembly of bands of tow in which the present invention is utilized.

According to the present invention, there is provided an apparatus for producing a layered assembly of bands of material such as ribbon or tow in which the layers are assembled in alignment with each other. The apparatus produces an assembly of bands of generally rectangular cross section having at least two layers of material comprising means for advancing a first band along a predetermined linear path and means for guiding a second band into layered alignment with the first band including a roll around which said second band is partially wrapped prior to contacting said first band, the second band having an initial tangential contact position with said roll along a line on the surface thereof extending generally axially with respect to the roll, the roll being tiltable in a plane defined by the axis thereof and the tangential initial contact position of said second band, whereby the lateral take-off position of the second band may be controlled by tilting said roll so as to guide it into aligned juxtaposition with said first band to form a layered, substantially rectangular tow band.

More specifically, the present invention provides apparatus for producing a tow band of generally rectangular cross section having at least two layers of filaments in closely adjacent, generally parallel relation comprising a) means for advancing a first filament band along a predetermined linear path in a manner such that the individual filaments thereof are in closely adjacent, generally parallel relation, b) means for advancing a second filament band into substantial juxtaposed alignment with the first filament band, the individual filaments of the second filament band being in closely adjacent, generally parallel relation, the means comprising a roll around which the filament band is partially wrapped prior to contacting the first band, the second band having an initial tangential contact position with the roll along a line on the surface thereof extending generally axially with respect to the roll, the roll being tiltable in a plane defined by the axis thereof and the initial tangential initial contact position of the second band, whereby the lateral take-off position of the second band may be controlled by tilting the roll so as to guide it into aligned juxtaposition with said first band to form a layered, substantially rectangular band.

An important aspect of this invention is that it is useful in the aligned layering of tow bands, or bands of filaments.

The apparatus according to this invention is especially useful in forming a multilayered assembly of tow bands in which a plurality of apparatuses are placed in series to form a multilayered assembly of tow bands in which each layer is accurately aligned with the other layers.

Normally, prior to placing a layer of filaments with the other layers, it will be advantageous to arrange the filaments in a generally side-by-side arrangement so that the individual filaments are in a closely adjacent, generally parallel arrangement. It is preferred that the individual filaments actually be touching each other.

Referring to the drawings, FIG. 1 represents a series of apparatuses (3 shown) according to the present invention in which a tow band 10 is being advanced in the direction of the arrow. At stations 12 and 14, additional tow bands 16 and 18 respectively are brought into layered relationship with tow band 10. It should be understood that while only 3 stations are shown in the drawing, as many corresponding to the ones shown as needed may be used. In conventional tow bands for producing cigarette filters, normally between 5 and 10 individual bands ("or ends") are brought into layered relationship. In a tow processing line, the completed band of ends from individual spinning cabinets is further processed by crimping, such as in a conventional stuffer box 20. Further processing often includes wrapping the crimped tow to form a rod, and then cutting the continuous length rod into individual pieces suitable in length for various purposes. Each of the tow bands 16 and 18 are guided over rolls 21 and 23 at station 12 and 25 and 27 at station 14 respectively. Rolls 23 and 27 are tiltable rolls in accordance with this invention and are described in detail hereinafter with reference to roll 32 in FIGS. 5 and 8–12. By tilting rolls 23 and 27 in accordance with this invention, tow bands 16 and 18 can be precisely aligned with tow band 10 to produce the layered arrangements shown in FIGS. 3 and 4. Guide rods 29 and 31 at stations 12 and 14 respectively are used to stack the ends in layered relationship.

Figure 2:
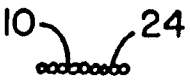
FIGS. 2, 3 and 4 are cross-sectional views taken along lines 2—2, 3—3 and 4—4 respectively.
Figure 3:
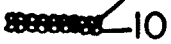
Figure 4:
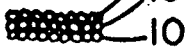

FIGS. 2, 3 and 4 show cross sections taken along lines 2—2, 3—3 and 4—4 respectively. In FIG. 2, a tow band consisting of a single end 10 of adjacent, side-by-side, generally parallel filaments 24 is illustrated. It should be understood that even at this point, the tow band may contain more than 1 layer or end. At stations 12 and 14, tow bands 16 and 18 are placed in layered relationship with tow band 10, as shown in FIGS. 3 and 4. It should be understood that, while three layers are illustrated in FIG. 4, there may be more as additional stations may be used between stations 12 and 14.

It should, at this point, be noted from FIGS. 3 and 4 that the layered tow ends are in lateral alignment, i.e., each tow end 10, 16 and 18 is directly above the previous one such that the edges thereof generally are in a plane substantially perpendicular to the plane in which the end lies so as to form a rectangular assembly. The present invention is directed to the apparatus which provides for such alignment of the individual ends, and will be described in detail below.

Figure 5:
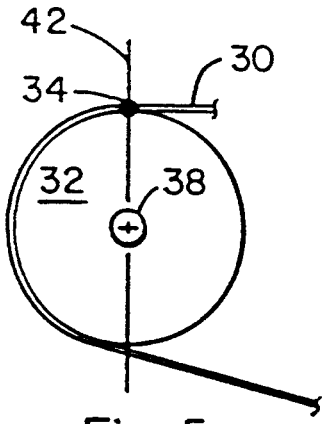
FIG. 5 is a schematic side view illustrating a tiltable roll for adjusting the take-off position of the tow band.
Figure 9:
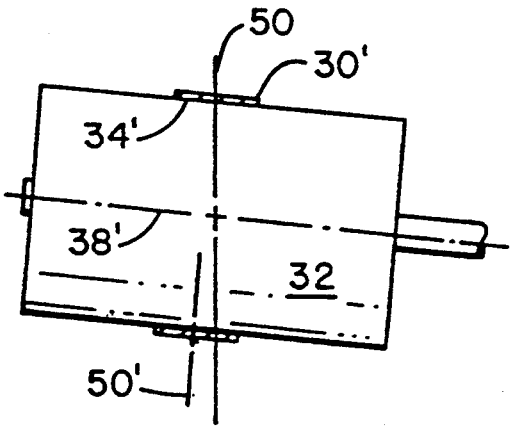
FIGS. 9 and 10 are views similar to FIG. 8, but illustrating the tilting of the roll so as to adjust the lateral position of the tow band to the desired position, i.e., in alignment with another tow band.
Figure 10:
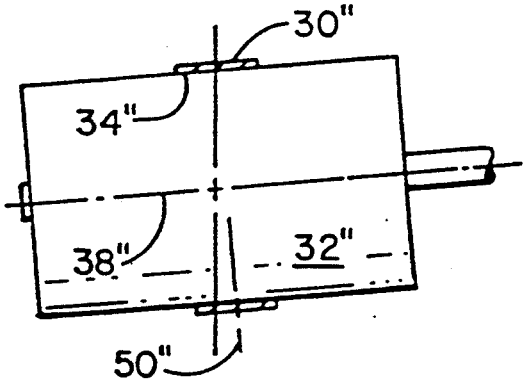

The apparatus according to this invention, as applied to tow ends for forming tow bands, is illustrated in diagrammatic form in FIG. 5. In these drawings, a tow end 30 is shown being guided by an "adjustable" godet roll 32. By adjustable it is meant that godet roll 32 can be tilted from its center position shown in FIG. 5 in a clockwise manner to a position as shown in FIG. 9 as represented at changed positions 30' and 32', or counterclockwise to a position such as shown in FIG. 10, as represented by changed positions 30" and 32". The maximum amount of possible rotation can be whatever desired for a particular situation, but normally a maximum arc in both directions, from the center position, of about 5 degrees is sufficient.

The tilting of roll 32 should be in a plane defined by the axis 38 thereof and the tangential initial contact position of the band 34. Thus, the plane in which roll 32 tilts is defined by the axis 38 of the roll 30 and a line 34 which is generally the tangential initial contact position of the second band.

As shown in FIG. 5, the tow band 30 has an initial tangential contact position located generally at 34. The other line which defines plane 42, in which roll 32 tilts, is the axis 38 of roll 32.

Figure 8:
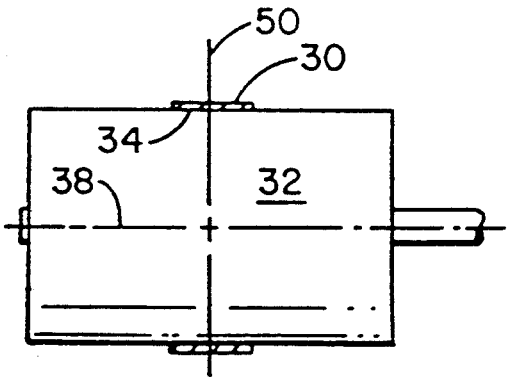
FIG. 8 is an elevation view of the roll shown in FIG. 5.

FIGS. 8, 9 and 10 illustrate the lateral movement of band 30 at the take-off position on roll 32. Centerline 50 is common to each of FIGS. 8, 9 and 10. FIG. 9 illustrates the lateral offset 50' of band 30' at take-off position when roll 32 is tilted slightly clockwise. FIG. 10 illustrates the lateral offset 50" of band 30" at take-off position when roll 32" is tilted slightly counterclockwise.

It is preferred that the band 30 wrap roll 32 for a circumferential arc of generally 160–180 degrees.

Figure 11:
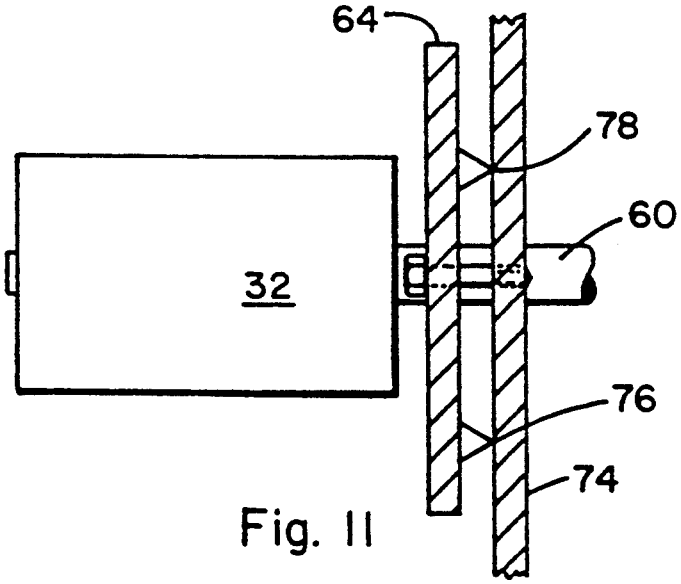
FIG. 11 is a plan view of the mechanism for tilting a roll according to this invention.
Figure 12:
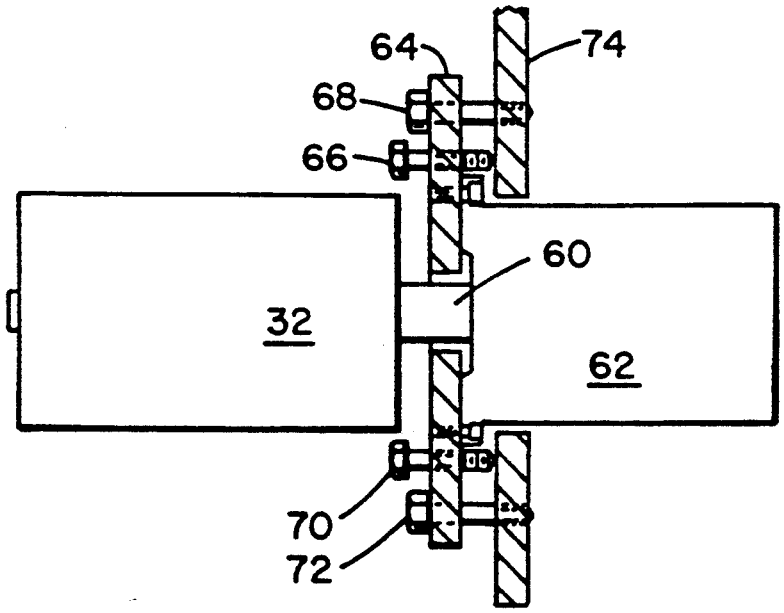
FIG. 12 is an elevation view of the mechanism shown in FIG. 11.

FIGS. 11 and 12 illustrate a preferred apparatus for tilting and supporting roll 32. Roll 32 is fixed to shaft 60 from electric motor 62. Motor 62 is mounted to tiltable plate 64 by means of two sets of set and lock bolts 66, 68 and 70, 72 respectively. Set bolts 66 and 70 serve to allow tilting by turning the bolts in coordination to obtain a particular desired tilt, as they are biased against frame plate 74. Lock bolts are threaded into plate 74 and serve to maintain the desired tilt. Therefore, as will be obvious to those skilled in the art, roll 32 may be tilted about points 76 and 78 by a simple loosening or tightening of the set and lock bolts on one side (e.g., 66 and 68) with the reverse procedure on the opposite side (70 and 72). This action will tilt the roll 32 in the desired direction as shown in FIGS. 6, 7, 9 and 10 to locate the lateral take off position of the band 30 correctly.

FIG. 11 is a plan view illustrating pivot points 76 and 78 which aid in maintaining alignment of the roll 32.

It can thus be seen that by adjusting the tilt of roll 32 (illustrated as rolls 23 and 27 in FIG. 1) as shown in FIGS. 5 and 8–10 and by the mechanism shown in FIGS. 11 and 12, tow bands 16 and 18 and be laterally positioned so as to be precisely aligned with tow band 10 shown in FIGS. 1–4.

The invention has been described in detail with particular reference to preferred embodiments thereof, but it will be understood that variations and modifications can be effected within the spirit and scope of the invention.

We claim:

1. Apparatus for producing a band of generally rectangular cross section having at least two layers of material comprising means for advancing a first band along a predetermined linear path and means for guiding a second band into layered alignment with said first band including a roll around which said second band is partially wrapped prior to contacting said first band, said second band having an initial tangential contact position with said roll along a line on the surface thereof extending generally axially with respect to said roll, said roll having roll support means for setting a roll angle of said roll and the tangential initial contact position of said second band thereby allowing said roll to tilt in a plane perpendicular to the plane in which said second band lies as it approaches said roll, whereby the lateral take-off position of the second band may be controlled by tilting said roll so as to guide it into aligned juxtaposition with said first band to form a layered, substantially rectangular tow band.

2. Apparatus for producing a tow band of generally rectangular cross section having at least two layers of filaments in closely adjacent, generally parallel relation comprising a) means for advancing a first filament band along a predetermined linear path in a manner such that the individual filaments thereof are in closely adjacent, generally parallel relation, b) means for advancing a second filament band into substantial juxtaposed alignment with said first filament band, the individual filaments of said second filament band being in closely adjacent, generally parallel relation, said means comprising a godet roll around which said filament band is partially wrapped, said band having a tangential contact position widths said roll along a line on the surface thereof extending generally axially with respect to said roll, the roll having a roll support means for setting a roll angle tiltable in a plane defined by the axis of said roll and the tangential initial contact position of said band thereby allowing said roll to tilt in a plane perpendicular to the plane in which said second filament band lies as it approaches said roll, whereby the lateral take-off position of the second band may be controlled by tilting said roll so as to guide it into aligned juxtaposition with said first band to form a layered, substantially rectangular band.

* * * * *

UNITED STATES PATENT AND TRADEMARK OFFICE

CERTIFICATE OF CORRECTION

PATENT NO. : 5,282,294

DATED : February 1, 1994

INVENTOR(S) : Albert E. Spaller, Jr., Whitney B. Carter, Fred W. Horne, Richard W. Nutter, Sr., David W. Thompson It is certified that error appears in the above-indentified patent and that said Letters Patent is hereby corrected as shown below:

Column 4, line 54, Claim 1 "angle of said" should read --- angle tiltable in a plane defined by the axis of said ---

Signed and Sealed this

Twenty-sixth Day of July, 1994

Bruce Lehman

*Attest:*

BRUCE LEHMAN

*Attesting Officer*

*Commissioner of Patents and Trademarks*